US009377250B2

(12) United States Patent
Landre

(10) Patent No.: US 9,377,250 B2
(45) Date of Patent: Jun. 28, 2016

(54) CROSS-FLOW HEAT EXCHANGER HAVING GRADUATED FIN DENSITY

(71) Applicant: The Boeing Company, Seal Beach, CA (US)

(72) Inventor: Eric G. Landre, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 726 days.

(21) Appl. No.: 13/665,396

(22) Filed: Oct. 31, 2012

(65) Prior Publication Data

US 2014/0116664 A1 May 1, 2014

(51) Int. Cl.

| | |
|---|---|
| ***F28D 9/00*** | (2006.01) |
| ***F28F 3/02*** | (2006.01) |
| *F28D 21/00* | (2006.01) |

(52) U.S. Cl.

CPC ..... *F28F 3/025* (2013.01); *F28D 9/0062* (2013.01); *F28D 2021/0021* (2013.01); *F28F 2215/04* (2013.01)

(58) Field of Classification Search

CPC ..... F28D 9/0062; F28D 2021/0021; F28F 2215/04; F28F 3/025; F28F 3/027

USPC ..... 165/165, 166, 167

See application file for complete search history.

(56) References Cited

U.S. PATENT DOCUMENTS

| | | | | |
|---|---|---|---|---|
| 2,595,457 | A * | 5/1952 | Jensen et al. | 165/166 |
| 3,542,124 | A * | 11/1970 | Bridgnell et al. | 165/166 |
| 3,775,972 | A * | 12/1973 | Perpall | 60/599 |
| 4,049,051 | A * | 9/1977 | Parker | 165/166 |
| 4,198,830 | A * | 4/1980 | Campbell | 62/87 |
| 4,262,495 | A | 4/1981 | Gupta et al. | |
| 4,285,466 | A | 8/1981 | Linscheid et al. | |

(Continued)

FOREIGN PATENT DOCUMENTS

| | | | |
|---|---|---|---|
| DE | 102004050758 | A1 | 4/2006 |
| FR | 2499233 | A1 | 8/1982 |

(Continued)

OTHER PUBLICATIONS

Extended European Search Report, European Application No. 13185808.6 (foreign counterpart of instant application), dated Sep. 17, 2014.

(Continued)

*Primary Examiner* — Tho V Duong

(74) *Attorney, Agent, or Firm* — Ostrager Chong Flaherty & Broitman P.C.

(57) ABSTRACT

The heat transfer capacity of a cross-flow heat exchanger can be increased by changing or graduating the density of the fins that form a row of hot passages in the direction normal to those fins. In accordance with some embodiments, the fin density in each row of hot passages is lower in a first region near the cold air inlets than it is in a second region located between the first region and the cold air outlets. This has the beneficial effect of increasing the rate of flow of hot air through hot passages adjacent or near to the cold air inlets of the heat exchanger, i.e., where the temperature of the cold air is coldest. As cold air flows along each cold passage, the cold air is heating up, becoming less capable of cooling the hot air in the adjacent hot passages as it gets closer to the cold air outlets. In addition or alternatively, the cold passages may have a non-uniform fin density that increases heat transfer capacity.

20 Claims, 7 Drawing Sheets

(56) References Cited

U.S. PATENT DOCUMENTS

| | | | | |
|---|---|---|---|---|
| 4,482,114 | A | 11/1984 | Gupta et al. | |
| 4,623,019 | A * | 11/1986 | Wiard | 165/146 |
| 7,121,100 | B2 | 10/2006 | Atkey et al. | |
| 7,871,038 | B2 | 1/2011 | Space et al. | |
| 9,033,030 | B2 * | 5/2015 | Des Champs | 165/166 |
| 2004/0177668 | A1 | 9/2004 | Sagasser et al. | |
| 2005/0274501 | A1 * | 12/2005 | Agee | 165/146 |
| 2006/0289152 | A1 * | 12/2006 | Leuschner et al. | 165/152 |
| 2012/0216545 | A1 | 8/2012 | Sennoun et al. | |

FOREIGN PATENT DOCUMENTS

| | | | |
|---|---|---|---|
| JP | 60238684 | A | 11/1985 |
| JP | 60238689 | A | 11/1985 |

OTHER PUBLICATIONS

European Examination Report, European Application No. 13185808.6 (foreign counterpart of instant application), dated Dec. 14, 2015.

* cited by examiner

CROSS-FLOW HEAT EXCHANGER HAVING GRADUATED FIN DENSITY

BACKGROUND

This disclosure generally relates to heat exchangers and, more specifically, relates to cross-flow heat exchangers used in conjunction with aircraft environmental control systems.

Traditionally, pressurized aircraft have an environmental control system (ECS) for maintaining cabin pressurization and controlling cabin temperatures during flight. In order to maintain pressurization and control temperature, outside air is supplied to the cabin via air conditioning packs and a portion of the air in the cabin is recirculated by recirculation fans to provide an acceptable level of volumetric airflow to the aircraft passengers.

It is known to supply pressurized air to an ECS using a compressor section of a gas turbine engine. This pressurized air is commonly called "bleed air" and is bled from bleed ports located at various stages of compression in a multi-stage compressor section of the engine. To supply sufficient bleed air over the operating range of the aircraft, typically a high-pressure bleed port is used. The temperature of this bleed air is normally too high for the ECS and some precooling of the bleed air is required.

It is known to install (e.g., inside the engine nacelle) a cross-flow, air-to-air heat exchanger, called a precooler, for cooling hot air bled from a compressor of a gas turbine engine. That cooled air is then supplied to the aircraft ECS. In accordance with a known system, the hot bleed air is cooled in the precooler by cold air diverted from and then returned to the fan duct.

Precooled air for the ECS travels through air conditioning packs to provide essentially dry, sterile, and dust-free conditioned air to the airplane cabin. This conditioned air is then mixed with a predetermined amount of cabin recirculated air and delivered to the aircraft cabin. Trim air, taken downstream of the precooler, may be added to warm the conditioned air to a suitably comfortable level for the aircraft cabin.

For a given volume set of constraints (e.g., volume, maximum pressure drops, etc.), it is desirable to increase the heat transfer capacity of a precooler. That increased heat transfer capacity would allow the designer to reduce the heat exchanger volume (and weight) or achieve higher performance. In either case, the fuel consumption penalty attributable to the extracted bleed air can be reduced.

For example, FIG. 2 illustrates a typical precooler construction. This typical precooler 10 is a cross-flow air-to-air heat exchanger comprising a stack of N rows of air passages, where N is an odd integer equal to 3 or more. If the stacked rows of passages were to be numbered from 1 to N, starting at the bottom of the precooler, then it can be seen in FIG. 2 that the odd-numbered rows are aligned in a first direction indicated by the arrow labeled "COLD FLUID", while the even-numbered rows are aligned in a second direction indicated by the arrow labeled "HOT FLUID". (Alternatively, there are some precooler constructions with odd-numbered rows on the hot fluid side and even-numbered rows on the cold fluid side.) In the construction shown in FIG. 2, the second direction is perpendicular to the first direction.

Each air passage seen in FIG. 2 has openings at both ends and a constant cross-sectional area along its length. In a well-known manner, the openings of the odd-numbered rows of passages 12 located on one side of precooler 10 which is visible in FIG. 2 (hereinafter "cold air front side") are in fluid communication with a source of cold air, while the openings of the even-numbered rows of passages 14 located on the other side of precooler 10 which is visible in FIG. 2 (hereinafter "hot air front side") are in fluid communication with a source of hot air. For the purpose of discussion, passages 12 will be referred to as "cold passages" and passages 14 will be referred to as "hot passages" to reflect the difference in temperatures of the air flowing through those passages.

In accordance with the construction shown in FIG. 2, the passages within any row have the same height. A person skilled in the art will recognize that the height of cold passages 12 may be different than the height of hot passages 14. The rows of cold and hot passages are arranged so that each row of hot passages 14 is sandwiched between a row of cold passages 12 disposed directly above and a row of cold passages 12 disposed directly below. (Alternatively, each row of cold passages could be sandwiched between respective hot passages above and below.) Adjacent rows of hot and cold passages are thermal-conductively coupled to each other by means of respective rectangular planar parting plates disposed inside precooler 10 in mutually parallel relationship. A precooler with N rows of stacked hot and cold passages has (N−1) parting plates.

The parting plates are rigidly supported in a mutually parallel relationship by a frame that comprises a multiplicity of pairs of mutually parallel cold passages closure bar 18 (a respective pair of cold passages closure bar flanking each row of cold passages), a multiplicity of pairs of mutually parallel hot passages closure bar 20 (a respective pair of hot passages closure bar flanking each row of hot passages) oriented perpendicular to the cold passages closure bar and having ends interleaved between the ends of cold passages closure bar 18, and a pair of side plates 22 and 24 which are respectively affixed to the outermost (first and last) pairs of cold passages closure bar 18. (In other embodiments, the side plates could be affixed to outermost pairs of hot passages closure bars.) The side plates 22, 24 are disposed parallel to the parting plates and adjacent to the first and N-th rows of air passages, which in the depicted construction are cold passages.

During operation of precooler 10 shown in FIG. 2, cold air flows through cold passages 12 and hot air flows through hot passages 14, which results in the transfer of heat from the hot air to the cold air by thermal conduction. The heat exchanger thus extracts heat from the hot air to lower its temperature to the degree required by the particular application.

Still referring to FIG. 2, it is known to form each row of air passages using a multiplicity of mutually parallel fins which extend between a respective pair of adjacent parting plates. In FIG. 2, fins 26 partly define cold passages 12, while fins 28 partly define hot passages 14. In accordance with the construction depicted in FIG. 2, fins 26 are spaced at equal intervals within each row of cold passages 12 (i.e., the rows of cold passages have a constant fin density), while fins 28 are spaced at equal intervals within each row of hot passages 14 (i.e., the rows of hot passages have a constant fin density).

In yet another example of the prior art, FIG. 3 shows the hot air front side of a precooler having constant fin density, i.e., the view in FIG. 3 is taken on the side where hot air enters the hot passages. Each row of hot passages 14 comprises a corrugated sheet 30 made of metal or metal alloy which is placed between a pair of parting plates 16. The corrugated metal sheet 30 is formed by folding. Each corrugated metal sheet 30 is made of a corrosion-resistant metal or metallic alloy having a high thermal conductivity.

As seen in FIG. 3, each corrugated metal sheet 30 has three types of corrugated sheet segments: passage top segments 32, passage bottom segment 34, and fins 28 which connect passage ceiling segments 32 to passage floor segments 34. In the case of a particular pair of adjacent hot passages 14*a* and 14*b* shown in FIG. 3, the first hot passage 14*a* is formed by fins 28*a*, 28*b*, a passage top segment 30*a* connecting fins 28*a*, 28*b*, and a portion of a lower parting plate 16*a* that opposes passage top segment 30*a* across hot passage 14*a*, whereas the second hot passage 14*b* is formed by fins 28*b*, 28*c*, a passage bottom segment 34*a* connecting fins 28*b*, 28*c*, and a portion of the upper parting plate 16*b* that opposes passage bottom segment 34*a* across hot passage 14*b*.

Preferably, all of the passage top segments 32 in each row of hot passages are brazed to the bottom surface of a respective parting plate disposed above the row, while all of the passage bottom segments 34 in each row of hot passages are brazed to the top surface of a respective parting plate disposed below the row. The preferred brazing material has high thermal conductivity, thereby facilitating the transfer of heat at the interface between a parting plate and a passage top or bottom segment. The above-described corrugated structure is repeated across each row for all rows of hot passages. The rows of cold passages (not visible in FIG. 3) may have a similar construction.

Referring again to FIG. 3, a heat exchanger is depicted in which the fin density across each row of hot passages is constant. Likewise the fin density across each row of cold passages is constant.

There is a need for improvements to ECS precoolers that increase the precooler's heat transfer capacity for a given set of volume constraints.

SUMMARY

The subject matter disclosed herein is a cross-flow air-to-air heat exchanger in which rows of hot passages are interleaved with rows of cold passages, adjacent rows of hot and cold passages being separated by respective parting plates made of a corrosion-resistant metal or metallic alloy having a high thermal conductivity (e.g., Inconel). Preferably, the parting plates are parallel to each other. The parting plates act as heat sinks which facilitate the transfer of heat from hot passages to cold passages, thereby cooling the hot air that flows through the heat exchanger.

In accordance with one embodiment, the heat exchanger has four sides and rectangular planar parting plates having the same shape and dimensions. All of the hot passages can be oriented parallel to a first axis while all of the cold passages can be oriented parallel to a second axis which is not parallel to (and can be perpendicular to) the first axis. The cold air enters the cold passages on a first side of the heat exchanger and exits the cold passages on a second side of the heat exchanger opposite to the first side; similarly, the hot air enters the hot passages on a third side of the heat exchanger and exits the hot passages on a fourth side of the heat exchanger opposite to the third side.

Each row of passages may be formed in part by a respective multiplicity of fins. In accordance with some embodiments, the fins of any row of passages are parallel to each other. For example, the fins may be oriented perpendicular to the adjacent parting plates, thereby forming passages which have rectangular cross sections. Alternatively, the fins of each row of passages could be oriented to form passages having trapezoidal cross sections. Such a row comprises a first set of mutually parallel fins interleaved with a second set of mutually parallel fins, the fins of the second set being not parallel with the fins of the first set.

The fins may be formed by folding a metal sheet to form corrugations. Each corrugated metal sheet is installed between a respective pair of adjacent parting plates. Each corrugated metal sheet is made of a corrosion-resistant metal or metallic alloy having a high thermal conductivity. When viewed with respect to a hypothetical midplane, the corrugated metal sheet comprises alternating ridges and grooves. Alternatively, the same corrugated metal sheet can be described in terms of three types of corrugated sheet segments: a passage top segment, a passage bottom segment, and a passage wall connecting a passage top segment to a passage bottom segment.

Throughout this disclosure, the passage walls will be referred to as "fins", and the passage top and bottom segments will not be so designated, i.e., for the purpose of this disclosure, the term "fins" in the appended claims should not be construed to encompass passage top segments or passage bottom segments of a corrugated metal sheet.

In the case of two adjacent passages in any row of hot or cold passages formed by a corrugated metal sheet disposed between top and lower parting plates, the first air passage can be formed by first and second fins, a first passage top segment connecting the first and second fins, and a portion of the lower parting plate disposed between the first and second fins and opposite to the first passage top segment, whereas the second air passage can be formed by the second fin and a third fin, a first passage bottom segment connecting the second and third fins, and a portion of the upper parting plate disposed between the second and third fins and opposite to the first passage bottom segment. This structure is repeated across the row of passages.

Preferably, all of the passage top segments are brazed to the upper parting plate, while all of the passage bottom segments are brazed to the lower parting plate. The preferred brazing material has high thermal conductivity, thereby facilitating the transfer of heat at the interface between a parting plate and a passage top or bottom segment.

In accordance with alternative embodiments, instead of using corrugated metal sheets, each row of passages could be formed by brazing a set of mutually parallel fins to the adjacent parting plates. For example, brazing material could be placed on both sides of each fin at the latter's top and bottom to form fillets made of brazing material.

As used herein, the term "fin density" means a number of fins per unit length (e.g., inch). It is known to provide a cross-flow heat exchanger in which each row of hot and cold passages has a uniform (i.e., constant) fin density in a direction normal to the fins that form those passages.

In accordance with the subject matter disclosed herein, the heat transfer capacity of a cross-flow heat exchanger can be increased by changing or graduating the density of the fins, which partly define a row of adjacent hot passages, in a direction normal to those fins. In accordance with some embodiments, the fin density in each row of hot passages is lower in a first region near the cold air inlets than it is in a second region located between the first region and the cold air outlets. This has the beneficial effect of increasing the rate of flow of hot air through hot passages adjacent or near to the cold air inlets of the heat exchanger, i.e., where the temperature of the cold air is coldest. As cold air flows along each cold passage, the cold air is heating up, becoming less capable of cooling the hot air in the adjacent hot passages as it gets closer to the cold air outlets.

In addition or alternatively, this concept can also be applied to the cold passages, i.e., by changing or graduating the density of the fins that form a row of cold passages in the direction normal to those fins.

One aspect of the disclosed subject matter is a system comprising a source of relatively colder fluid, a source of relatively hotter fluid, and a cross-flow fluid-to-fluid heat exchanger connected to receive fluid from the sources of relatively colder and hotter air, wherein the heat exchanger comprises: a first multiplicity of fins which partly define a first row of passages having respective fluid inlets connected to receive fluid from the source of relatively hotter fluid and respective fluid outlets in fluid communication with the respective fluid inlets of the first row of passages; a second multiplicity of fins which partly define a second row of passages having respective fluid inlets connected to receive fluid from the source of relatively colder fluid and respective fluid outlets in fluid communication with the respective fluid inlets of the second row of passages; and a plate disposed between the first and second multiplicities of fins, wherein at least one of the first and second multiplicities of fins has a non-uniform fin density.

In accordance with some embodiments, the non-uniform fin density comprises a first fin density in a first region and a second fin density in a second region of at least one of the first and second rows of passages, the first fin density being less than the second fin density. The first region is closer than the second region to the fluid inlets of the other of the first and second rows of passages. Optionally, the non-uniform fin density decreases in graduations from the fluid inlets to the fluid outlets of the other of the first and second rows of passages.

Although the fluid is air in the disclosed embodiments, the concept of increasing the fin density with increasing distance from the air inlets of the passages has application in cross-flow heat exchangers which use other types of fluid, such as water or oil. In one embodiment, the sources of relatively colder and relatively hotter fluids are respectively a fan duct and a compressor of a gas turbine engine. An environmental control system can be connected to receive cooled air from the heat exchanger.

Another aspect is a system comprising a source of relatively colder air, a source of relatively hotter air, and a cross-flow air-to-air heat exchanger connected to receive air from the sources of relatively colder and hotter air, wherein the heat exchanger comprises: a first multiplicity of fins which partly define a first row of passages having respective air inlets connected to receive air from the source of relatively hotter air and respective air outlets in fluid communication with the respective air inlets of the first row of passages; a second multiplicity of fins which partly define a second row of passages having respective air inlets connected to receive air from the source of relatively colder air and respective air outlets in fluid communication with the respective air inlets of the second row of passages; and a plate disposed between the first and second multiplicities of fins, wherein the first multiplicity of fins has a first fin density in a first region and a second fin density greater than the first fin density in a second region, and the first region is closer than the second region to the air inlets of the first row of passages.

A further aspect of the subject matter disclosed herein is a cross-flow heat exchanger comprising: a first multiplicity of fins which partly define a first row of passages extending in a first direction, each passage of the first row having respective openings at opposite ends thereof; a second multiplicity of fins which partly define a second row of passages extending in a second direction that is not parallel to the first direction, each passage of the second row having respective openings at opposite ends thereof; and a plate disposed between the first and second multiplicities of fins, wherein the first multiplicity of fins comprise first, second and third fins, the first and second fins partly defining a first passage of the first row of passages having a first constant cross-sectional area along its length, and the second and third fins partly defining a second passage of the first row of passages having a second constant cross-sectional area along its length, the first constant cross-sectional area being greater than the second constant cross-sectional area. Since the heights of the passages in the first row are the same, a greater cross-sectional area of the passage corresponds to a reduced fin density (assuming that the fins of the first multiplicity are mutually parallel). More specifically, the first and second fins are separated by a first distance, and the second and third fins are separated by a second distance less than the first distance. The first multiplicity of fins may comprise respective portions of a continuous corrugated sheet made of metal or metal alloy.

Yet another aspect is a cross-flow heat exchanger comprising: a first multiplicity of fins which partly define a first row of passages extending in a first direction, each passage of the first row having respective openings at opposite ends thereof; a second multiplicity of fins which partly define a second row of passages extending in a second direction that is not parallel to the first direction, each passage of the second row having respective openings at opposite ends thereof; a third multiplicity of fins which partly define a third row of passages extending in the first direction, each passage of the third row having respective openings at opposite ends thereof; a first plate disposed between the first and second multiplicities of fins; and a second plate disposed between the second and third multiplicities of fins, wherein the second row of passages is sandwiched between the first and third rows of passages, thermal conductively coupled to the first row of passages via at least the first plate, and thermal conductively coupled to the third row of passages via at least the second plate, and wherein the second multiplicity of fins has a non-uniform fin density which varies in a direction normal to the second direction. Optionally, each multiplicity of fins may comprise respective portions of a respective continuous corrugated sheet made of metal or metal alloy.

Another aspect is a method for enhancing performance of a cross-flow heat exchanger, comprising the following steps performed concurrently: passing cold fluid through a first row of passages of the heat exchanger, the passages of the first row being separated by fins; passing hot fluid through first and second sets of passages of a second row of passages of the heat exchanger, the second row of passages being thermal conductively coupled to the first row of passages such that hot fluid flowing through the second row of passages is cooled by cold fluid in the first row of passages, the passages of the second row being separated by fins, wherein the first set of passages of the second row have a first fin density and the second set of passages of the second row have a second fin density less than the first fin density. The first set of passages of the second row are disposed within a distance of a fluid inlet side of the first row of passages and the second set of passages of the second row are disposed further away than that distance from the fluid inlet side of the first row of passages.

Other aspects of ECS precoolers having improved heat transfer capacity are disclosed below.

BRIEF DESCRIPTION OF THE DRAWINGS

Reference will hereinafter be made to the drawings in which similar elements in different drawings bear the same reference numerals.

DETAILED DESCRIPTION

Figure 1:
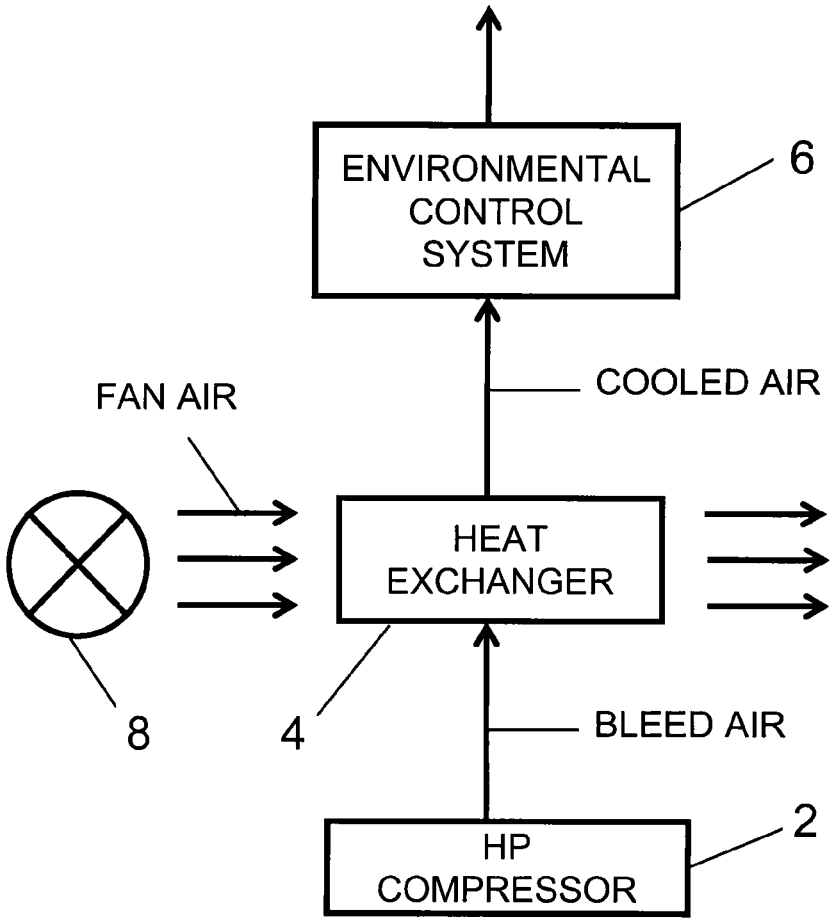
FIG. 1 is a block diagram showing an aircraft system comprising a precooler for cooling hot compressed air bled from a compressor for supply to an environmental control system.
Figure 2:
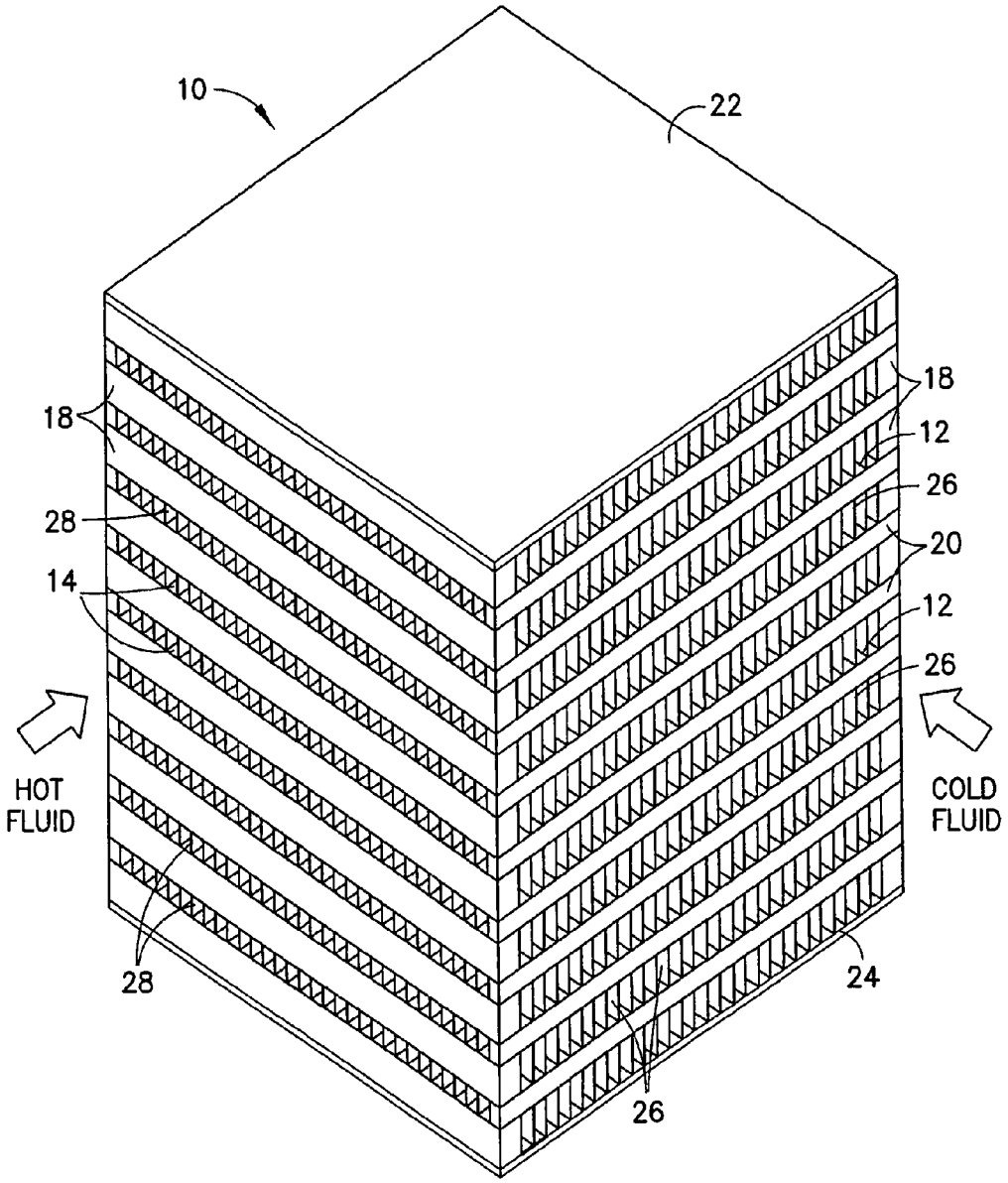
FIG. 2 PRIOR ART
FIG. 2 is a diagram showing an isometric view of a prior art precooler construction that is lacking the improvements disclosed herein.

FIG. 1 shows some components of an aircraft compressor bleed air supply system comprising a heat exchanger 4 for cooling hot compressed air bled from a high-pressure compressor 2 of a gas turbine aircraft engine and then supplying that cooled air to an environmental control system 6. The precooler may comprise a cross-flow air-to-air heat exchanger 4 in fluid communication with a source of cooling air, which in the illustrated embodiment is a portion of the rearward air flow produced by the fan 8 of the engine. The heat exchanger 4 may be in flow communication with an annular bypass duct (not shown) of the aircraft engine. The precooler may also include a variable precooler bypass (not shown) that may be used to bypass the compressor bleed air around the heat exchanger 4.

Conventional precooler heat exchangers are made from Inconel in order to withstand the heat and pressure of the bleed air, but may alternatively be constructed of aluminum or titanium.

An electronic controller (not shown) is used to control the operation of this compressor bleed air supply system. The electronic controller is used to control full or partial opening and closing of various valves (not shown) incorporated in the compressor bleed air supply system.

The air-to-air heat exchanger 4 may be disposed, for example, inside a core cowl (not shown) surrounding the core engine at a base of struts supporting the nacelle (not shown) and in suitable flow communication with the bypass duct. A suitable inlet scoop or door (not shown) in the core cowl operates as a variable fan air valve controlled by the electronic controller. The variable fan air valve (not shown) modulates and channels the cooling fan air downstream through the heat exchanger 4. The cooling fan air is then conveyed through an outlet channel (not shown), returning the cooling fan air to the bypass duct upstream of a fan outlet at a trailing edge of the nacelle. Another option is for outlet fan air to be ducted and dumped overboard.

The heat exchanger 4 is used to cool the compressor bleed air from the high-pressure compressor 2 with the portion of the fan air diverted from the bypass duct. The cooled compressor bleed air then flows to the environmental control system 6 for use therein. In one embodiment, the compressor bleed air is bled from one of two separate stages (not shown) of the high-pressure compressor 2. Bleed shutoff valves (not shown) may be disposed between the high-pressure compressor 2 and the heat exchanger 4 for opening and closing individual bleed lines under control of the aforementioned electronic controller. The pressure of the compressor bleed air may be measured by a pressure sensor incorporated in a regulating shut off valve (not shown) installed in the bleed air inlet line (labeled "BLEED AIR" in FIG. 1) that connects to the air-to-air heat exchanger 4. The pressure regulating shut off valve regulates an inlet pressure of the compressor bleed air entering the heat exchanger 4. The pressure regulating shut off valve is controlled by the electronic controller to maintain the inlet pressure in a specified range. A bleed air outlet line (labeled "COOLED AIR" in FIG. 1) connects the heat exchanger 4 to the ECS 6.

A temperature sensor (not shown) can be operably coupled to the bleed air outlet line for measuring a precooler exit temperature of the compressor bleed air before it is conveyed to the ECS 6. The temperature sensor is connected to the electronic controller for controlling the fan air modulating valve based at least in part on the temperature measured by the temperature sensor. An optional pressure sensor may be operably coupled to the bleed air outlet line for measuring a precooler exit pressure, which may be used to measure pressure differential across the precooler. The electronic controller controls and operates the various valves in a manner to maintain the precooler exit temperature in a specified range.

The function of the compressor bleed air supply system shown in FIG. 1 is to supply compressor bleed air to the ECS 6 and optionally to the aircraft wing anti-icing system and to the nitrogen generation system (not shown). The compressor bleed air must be supplied at sufficient flow rates, pressures and temperatures to meet ECS requirements under normal and abnormal operating conditions.

Figure 3:
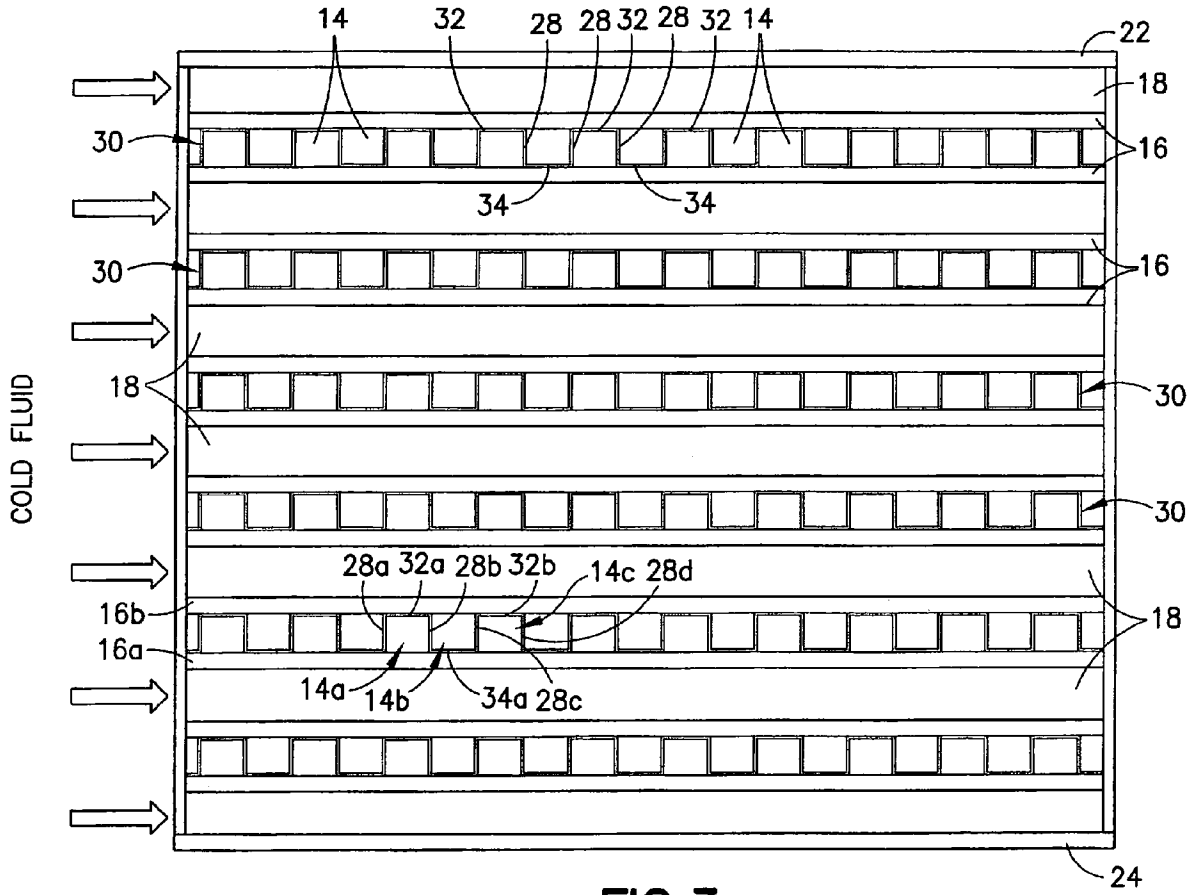
FIG.3 PRIOR ART
FIG. 3 is a diagram showing an elevation view of a prior art precooler having constant fin density, the view being taken on the side where hot bleed air from a compressor enters the hot passages of the precooler.
Figure 4:
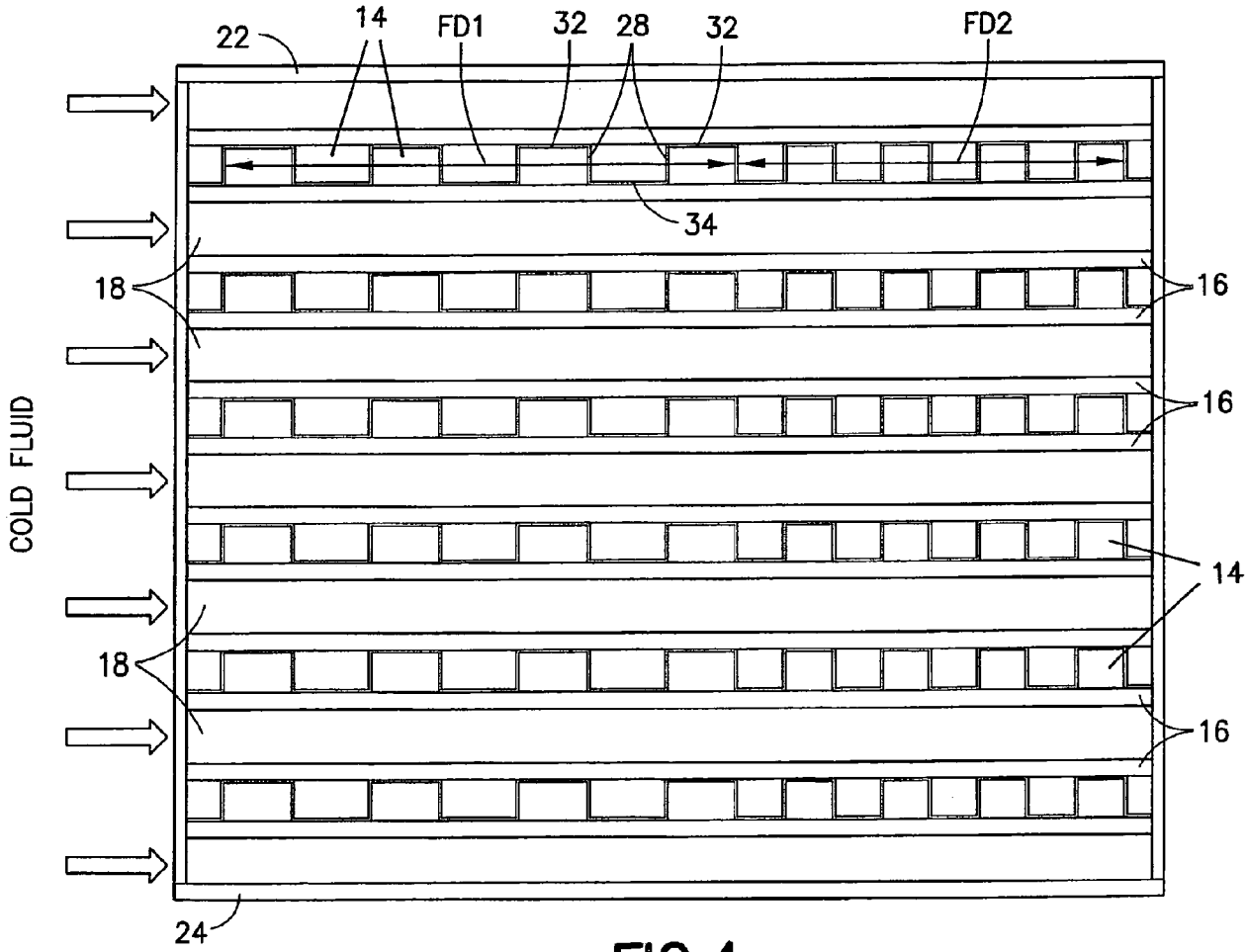
FIG. 4 is a diagram show of the present disclosure of an isometric view of a precooler construction in accordance with one embodiment.

In accordance with the improvement shown in FIG. 4, the heat transfer capacity of a cross-flow heat exchanger having the construction shown in FIG. 3 can be increased by changing or graduating the density of the fins, which partly define a row of adjacent hot passages, in a direction normal to those fins. In accordance with some embodiments, the fin density in each row of hot passages is lower in a first region near the cold air inlets than it is in a second region located between the first region and the cold air outlets. This has the beneficial effect of increasing the rate of flow of hot air through hot passages adjacent or near to the cold air inlets of the heat exchanger, i.e., where the temperature of the cold air is coldest. As cold air flows along each cold passage, the cold air is heating up, becoming less capable of cooling the hot air in the adjacent hot passages as it gets closer to the cold air outlets.

In accordance with the embodiment depicted in FIG. 4, each row of hot passages has a first region in which the fin density $FD_1$ is less than the fin density $FD_2$ in a second region (i.e., $FD_1<FD_2$), wherein the first region is disposed between the cold air front side of the precooler and the second region.

In accordance with variations of the embodiment depicted in FIG. 4, each row of hot passages could have M regions (where M is an integer greater than two), wherein the fin density in the first region is $FD_1$ is less than the fin density $FD_2$ in a second region, which in turn is less than the fin density $FD_3$ in a third region, etc. (i.e., $FD_1<FD_2<FD_3< \ldots <FD_M$), wherein the first through M-th regions are be disposed in sequence from left to right when the precooler is viewed from its hot air front side. This principle can be extended to provide a row of hot passages in which the distance separating successive fins decreases incrementally (i.e., the fin density increases incrementally) across the row of hot passages from the cold air front side to the cold air back side of the precooler, i.e., the fin density is graduated.

Figure 5:
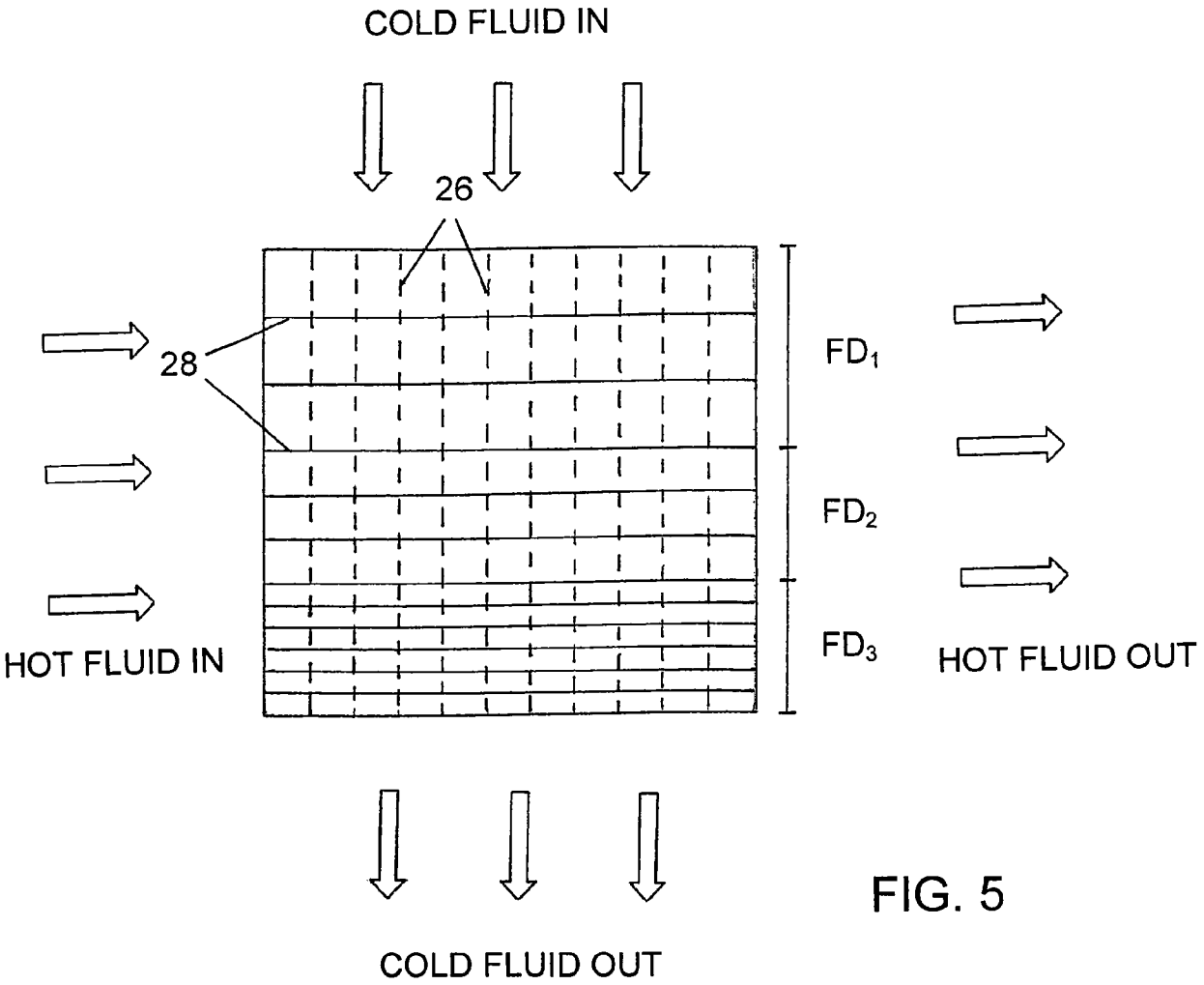
FIG. 5 is a diagram showing a top view of a row of hot passages disposed above a row of cold passages in accordance with one embodiment in which the hot passages are separated by fins having an increasing fin density in a direction from cold fluid inlets to cold fluid outlets.

FIG. 5 is a top view showing a fin density M=3 configuration wherein a row of hot passages, separated by parallel fins 28 (indicated by solid lines), are disposed above a row of cold passages, separated by a plurality of fins 26 (indicated by dashed lines) disposed perpendicular to fins 28. In this example, fins 26 have a constant fin density across the row of cold passages, while fins 28 have a fin density which increases from $FD_1$ to $FD_2$ to $FD_3$ across the hot passages in a direction from the cold fluid inlets to the cold fluid outlets.

Figure 6:
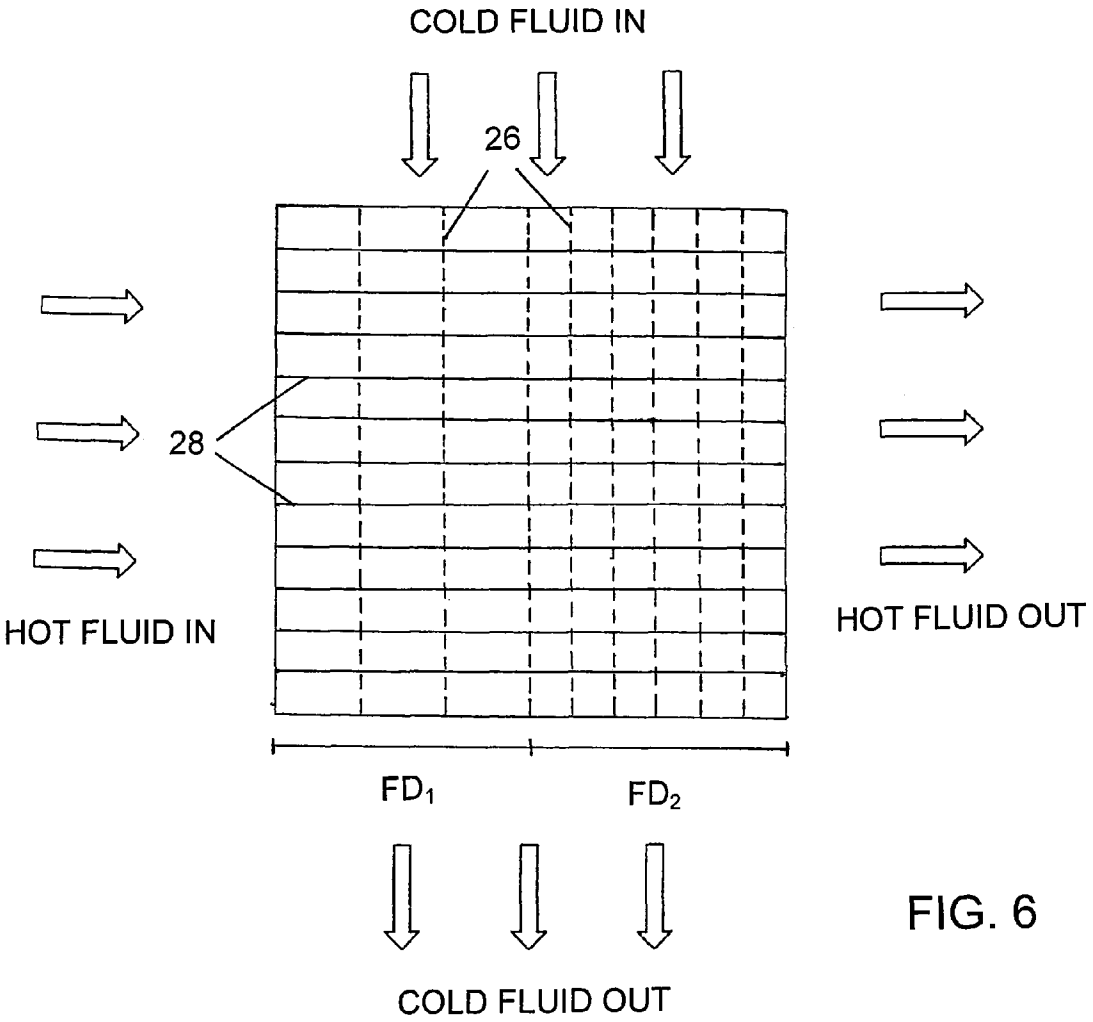
FIG. 6 is a diagram showing a top view of a row of hot passages disposed above a row of cold passages in accordance with another embodiment in which the cold passages are separated by fins having an increasing fin density in a direction from hot fluid inlets to hot fluid outlets.

In addition or alternatively, nonuniform fin density concept can also be applied to the cold passages, i.e., by changing or graduating the density of the fins that form a row of cold passages in the direction normal to those fins. FIG. 6 is a top view showing a configuration wherein a row of hot passages, separated by parallel fins 26 (indicated by solid lines), are disposed above a row of cold passages, separated by a plurality of fins 26 (indicated by dashed lines) disposed perpendicular to fins 28. In this example, fins 28 have a constant fin density across the row of hot passages, while fins 26 have a fin density which increases from $FD_1$ to $FD_2$ across the cold passages in a direction from the hot fluid inlets to the hot fluid outlets.

In accordance with one embodiment, the heat exchanger has four sides and rectangular planar parting plates having the same shape and dimensions. All of the hot passages can be oriented parallel to a first axis while all of the cold passages can be oriented parallel to a second axis which is not parallel to (and can be perpendicular to) the first axis. The cold air enters the cold passages on a first side of the heat exchanger and exits the cold passages on a second side of the heat exchanger opposite to the first side; similarly, the hot air enters the hot passages on a third side of the heat exchanger and exits the hot passages on a fourth side of the heat exchanger opposite to the third side.

Each row of passages may be formed in part by a respective multiplicity of fins. In accordance with some embodiments, the fins of any row of passages are parallel to each other. For example, the fins may be oriented perpendicular to the adjacent parting plates, thereby forming passages which have rectangular cross sections. Alternatively, the fins of each row of passages could be oriented to form passages having trapezoidal cross sections. Such a row comprises a first set of mutually parallel fins interleaved with a second set of mutually parallel fins, the fins of the second set being not parallel with the fins of the first set.

The fins may be formed by folding a metal sheet to form corrugations. Each corrugated metal sheet is installed between a respective pair of adjacent parting plates. Each corrugated metal sheet is made of a corrosion-resistant metal or metallic alloy having a high thermal conductivity. When viewed with respect to a hypothetical midplane, the corrugated metal sheet comprises alternating ridges and grooves. Alternatively, the same corrugated metal sheet can be described in terms of three types of corrugated sheet segments: a passage top segment, a passage bottom segment, and a passage wall connecting a passage top segment to a passage bottom segment. As previously noted, the passage walls are "fins", and the passage top and bottom segments will not be so designated, i.e., for the purpose of this disclosure. Also the term "fins" in the appended claims should not be construed to encompass passage top segments or passage bottom segments of a corrugated metal sheet.

In one embodiment, two adjacent passages in any row of hot or cold passages formed by a corrugated metal sheet disposed between top and lower parting plates, the first air passage can be formed by first and second fins, a first passage top segment connecting the first and second fins, and a portion of the lower parting plate disposed between the first and second fins and opposite to the first passage top segment. Continuing with this embodiment, the second air passage can be formed by the second fin and a third fin, a first passage bottom segment connecting the second and third fins, and a portion of the upper parting plate disposed between the second and third fins and opposite to the first passage bottom segment. Furthermore, this structure is repeated across the row of passages. Preferably in one example, all of the passage top segments are brazed to the upper parting plate, while all of the passage bottom segments are brazed to the lower parting plate. In this example, the preferred brazing material has high thermal conductivity, thereby facilitating the transfer of heat at the interface between a parting plate and a passage top or bottom segment.

In accordance with alternative embodiments, instead of using corrugated metal sheets, each row of passages could be formed by brazing a set of mutually parallel fins to the adjacent parting plates. For example, brazing material could be placed on both sides of each fin at the latter's top and bottom to form fillets made of brazing material.

In accordance with the subject matter disclosed herein, the heat transfer capacity of a cross-flow heat exchanger can be increased by changing or graduating the density of the fins, which partly define a row of adjacent hot passages, in a direction normal to those fins. In accordance with some embodiments, the fin density in each row of hot passages is lower in a first region near the cold air inlets than it is in a second region located between the first region and the cold air outlets. This has the beneficial effect of increasing the rate of flow of hot air through hot passages adjacent or near to the cold air inlets of the heat exchanger, i.e., where the temperature of the cold air is coldest. As cold air flows along each cold passage, the cold air is heating up, becoming less capable of cooling the hot air in the adjacent hot passages as it gets closer to the cold air outlets.

One aspect of the disclosed subject matter is a system comprising a source of relatively colder fluid, a source of relatively hotter fluid, and a cross-flow fluid-to-fluid heat exchanger connected to receive fluid from the sources of relatively colder and hotter air. In one example, the heat exchanger includes: a first multiplicity of fins which partly define a first row of passages having respective fluid inlets connected to receive fluid from the source of relatively hotter fluid and respective fluid outlets in fluid communication with the respective fluid inlets of the first row of passages, a second multiplicity of fins which partly define a second row of passages having respective fluid inlets connected to receive fluid from the source of relatively colder fluid and respective fluid outlets in fluid communication with the respective fluid inlets of the second row of passages, and a plate disposed between the first and second multiplicities of fins, wherein at least one of the first and second multiplicities of fins has a non-uniform fin density.

In accordance with some embodiments, the non-uniform fin density comprises a first fin density in a first region and a second fin density in a second region of at least one of the first and second rows of passages, the first fin density being less than the second fin density. The first region is closer than the second region to the fluid inlets of the at least one of the first and second rows of passages. Optionally, the non-uniform fin density decreases in graduations from the fluid inlets to the fluid outlets of the at least one of the first and second rows of passages.

Although the fluid is air in the disclosed embodiments, the concept of increasing the fin density with increasing distance from the air inlets of the passages has application in cross-flow heat exchangers which use other types of fluid, such as water or oil. In one embodiment, the sources of relatively colder and relatively hotter fluids are respectively a fan duct and a compressor of a gas turbine engine. An environmental control system can be connected to receive cooled air from the heat exchanger.

Another aspect is a system including a source of relatively colder air, a source of relatively hotter air, and a cross-flow air-to-air heat exchanger connected to receive air from the sources of relatively colder and hotter air, wherein the heat exchanger includes a first multiplicity of fins which partly define a first row of passages having respective air inlets connected to receive air from the source of relatively hotter air and respective air outlets in fluid communication with the respective air inlets of the first row of passages. In addition, a second multiplicity of fins may be included which partly define a second row of passages having respective air inlets connected to receive air from the source of relatively colder air and respective air outlets in fluid communication with the respective air inlets of the second row of passages. Furthermore, a plate may be disposed between the first and second multiplicities of fins. In one example, the first multiplicity of fins has a first fin density in a first region and a second fin density greater than the first fin density in a second region, and the first region is closer than the second region to the air inlets of the first row of passages.

In a further aspect of the subject matter disclosed herein is a cross-flow heat exchanger that includes a first multiplicity of fins which partly define a first row of passages extending in a first direction. In one instance, each passage of the first row having respective openings at opposite ends thereof and a second multiplicity of fins which partly define a second row of passages extending in a second direction that is not parallel to the first direction. In one example, each passage of the second row having respective openings at opposite ends thereof, and a plate disposed between the first and second multiplicities of fins. In one variation of this example, the first multiplicity of fins includes first, second and third fins, the first and second fins partly defining a first passage of the first row of passages having a first constant cross-sectional area along its length, and the second and third fins partly defining a second passage of the first row of passages having a second constant cross-sectional area along its length, the first constant cross-sectional area being greater than the second constant cross-sectional area.

Continuing with this example, since the heights of the passages in the first row are the same, a greater cross-sectional area of the passage corresponds to a reduced fin density (assuming that the fins of the first multiplicity are mutually parallel). More specifically, the first and second fins are separated by a first distance, and the second and third fins are separated by a second distance less than the first distance. The first multiplicity of fins may comprise respective portions of a continuous corrugated sheet made of metal or metal alloy.

Yet another aspect is a cross-flow heat exchanger comprising: a first multiplicity of fins which partly define a first row of passages extending in a first direction, each passage of the first row having respective openings at opposite ends thereof; a second multiplicity of fins which partly define a second row of passages extending in a second direction that is not parallel to the first direction, each passage of the second row having respective openings at opposite ends thereof, a third multiplicity of fins which partly define a third row of passages extending in the first direction, each passage of the third row having respective openings at opposite ends thereof, a first plate disposed between the first and second multiplicities of fins, and a second plate disposed between the second and third multiplicities of fins.

In one instance, the second row of passages is sandwiched between the first and third rows of passages, thermal conductively coupled to the first row of passages via at least the first plate, and thermal conductively coupled to the third row of passages via at least the second plate, and the second multiplicity of fins has a non-uniform fin density which varies in a direction normal to the second direction. Optionally, each multiplicity of fins may comprise respective portions of a respective continuous corrugated sheet made of metal or metal alloy.

Advantageously, as illustrated above, in addition or alternatively, the fin density in each row of cold passages can increase one or more times across the row of cold passages from the hot air front side to the hot air back side of the precooler.

Furthermore, by providing in the rows of hot passages a lower fin density near the cold air front side of the precooler, the distance separating adjacent fins in the lower fin density region will be greater than the distance separating adjacent fins in the higher fin density region. In the case where the height of the hot passages is constant within a given row, this means that the cross-sectional area of the hot passages in the lower fin density region will be greater than the cross-sectional area of the hot passages in the higher fin density region. The pressure differential across the hot passages will be the same for both the higher and lower fin density regions, but the greater cross-sectional area of the hot passages in the lower fin density region will cause hot air to flow through the hot passages in the lower fin density region at a higher flow rate than is the case for the hot passages in the higher fin density region.

For example, if the higher fin density were two times the lower fin density, the hot passages in the lower fin density region would have a cross-sectional area two times the hot passages in the higher fin density region. Obviously, the air flow rate through the hot passages in the lower fin density region will be greater than the air flow rate through the hot passages in the higher (by a factor of 2 or greater) fin density region due to boundary layer effects on the surfaces of the extra fins present in the higher fin density region.

Figure 7:
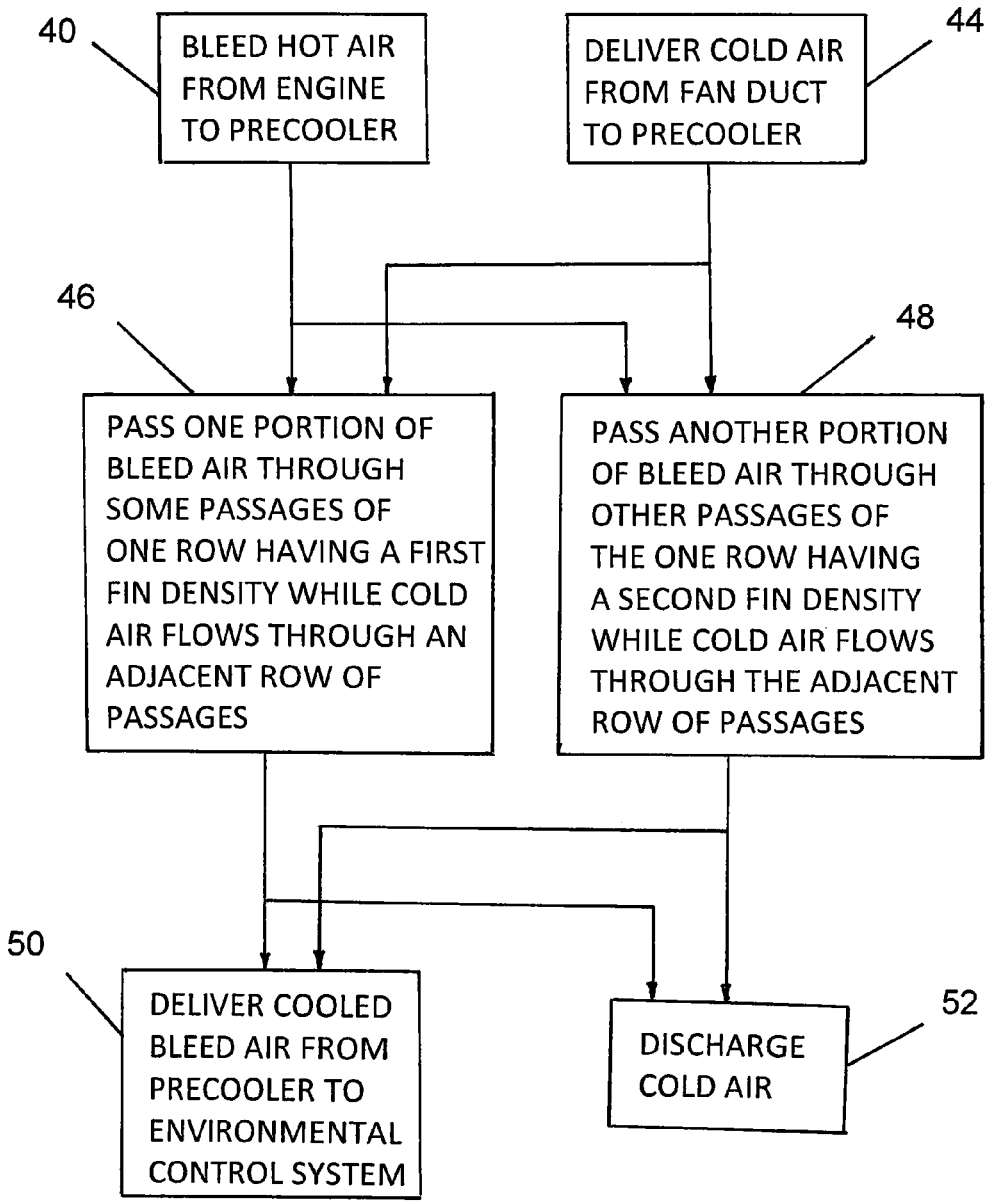
FIG. 7 is a flowchart showing a performance-enhancing method in accordance with one embodiment.

Another aspect of the teachings herein is a method for enhancing performance of a cross-flow heat exchanger. FIG. 7 is a flowchart showing a performance-enhancing method in accordance with one embodiment. Hot air is bled from an aircraft engine to a precooler (step 40).

At the same time, cold air from a fan duct is delivered to the precooler (step 44). One portion of the bleed air is passed through some passages of one row having a first fin density, while cold air flows through an adjacent row of passages (step 46). At the same time, another portion of the bleed air is passed through other passages of the one row having a second fin density, while cold air flows through the adjacent row of passages (step 48). If the first fin density is less than the second fin density, the hot air will flow faster through the passages having the first fin density as compared the rate of flow through the passages having the second fin density, thereby increasing the cooling of the bleed air. Still referring to FIG. 7, the cooled bleed air can be delivered from the precooler to an environmental control system (step 50). At the same time, the cold air is discharged from the precooler (step 52).

While various embodiments have been described, it will be understood by those skilled in the art that various changes may be made and equivalents may be substituted for elements thereof without departing from the scope of the disclosure. Therefore it is intended that the disclosure not be limited to the particular embodiments disclosed.

As used in the claims, the phrase "connected to receive fluid from" should be construed broadly to read on connections made via valves which can be opened and closed as well as connections made without intervening valves.

The invention claimed is:

1. A system comprising a source of relatively colder fluid, a source of relatively hotter fluid, and a cross-flow fluid-to-fluid heat exchanger connected to receive fluid from said source of relatively colder fluid and said source of relatively hotter fluid, wherein said heat exchanger comprises:

a first multiplicity of fins which partly define a first row of passages arranged side by side and aligned in a first direction, each passage of said first row having a fluid inlet connected to receive fluid from said source of relatively hotter fluid, a fluid outlet in fluid communication with said fluid inlet, and a constant height along its length;

a second multiplicity of fins which partly define a second row of passages arranged side by side and aligned in a second direction that is not parallel with said first direction, each passage of said second row having a fluid inlet connected to receive fluid from said source of relatively colder fluid, a fluid outlet in fluid communication with said fluid inlet, and a constant height along its length; and a first planar plate disposed between said first and second rows of passages, wherein said first and second rows of passages and said first planar plate form a stack in which respective portions of each passage of said first row are disposed above respective portions of respective passages of said second row in a cross-flow relationship that allows heat to be transferred from any one passage of said first row to all of the passages of said second row; and wherein said first multiplicity of fins have a first fin density in a first region occupied by some passages of said first row of passages and a second fin density in a second region occupied by other passages of said first row of passages, said first fin density being less than said second fin density, said first region being between said second region and a first side of the heat exchanger where said fluid inlets of said second row of passages are located.

2. The system as recited in claim 1, further comprising:

a third multiplicity of fins which partly define a third row of passages arranged side by side and aligned in said first direction, each passage of said third row having a fluid inlet connected to receive fluid from said source of relatively hotter fluid, a fluid outlet in fluid communication with said fluid inlet, and a constant height along its length; and a second planar plate disposed between said second and third rows of passages, wherein said first, second and third rows of passages and said first and second planar plates form a stack in which respective portions of each passage of said third row are disposed below respective portions of respective passages of said second row in a cross-flow relationship that allows heat to be transferred from any one passage of said third row to all of the passages of said second row; and wherein said third multiplicity of fins have said first fin density in a first region occupied by some passages of said third row of passages and said second fin density in a second region occupied by other passages of said third row of passages, said first region being between said second region and said first side of the heat exchanger.

3. The system as recited in claim 1, wherein said second multiplicity of fins have a third fin density in a first region occupied by some passages of said second row of passages and a fourth fin density in a second region occupied by other passages of said second row of passages, said third fin density being less than said fourth fin density, said first region being between said second region and a second side of the heat exchanger where said fluid inlets of said first row of passages are located.

4. The system as recited in claim 1, wherein said fluid is air.

5. The system as recited in claim 1, wherein said source of relatively colder fluid is a fan duct of a gas turbine engine.

6. The system as recited in claim 1, wherein said source of relatively hotter fluid is a compressor of a gas turbine engine.

7. The system as recited in claim 1, further comprising an environmental control system connected to receive fluid from said fluid outlets of said first row of passages.

8. A system comprising a source of relatively colder air, a source of relatively hotter air, and a cross-flow air-to-air heat exchanger connected to receive air from said source of relatively colder air and said source of relatively hotter air, wherein said heat exchanger comprises:

a first multiplicity of fins which partly define a first row of passages arranged side by side and aligned in a first direction, each passage of said first row having an air inlet connected to receive air from said source of relatively hotter air, an air outlet in fluid communication with said air inlet, and a constant height along its length;

a second multiplicity of fins which partly define a second row of passages arranged side by side and aligned in a second direction that is not parallel with said first direction, each passage of said second row having an air inlet connected to receive air from said source of relatively colder air, an air outlet in fluid communication with said air inlet, and a constant height along its length; and a first planar plate disposed between said first and second rows of passages, wherein said first and second rows of passages and said first planar plate form a stack in which respective portions of each passage of said first row are disposed above respective portions of respective passages of said second row in a cross-flow relationship that allows heat to be transferred from any one passage of said first row to all of the passages of said second row; and wherein said first multiplicity of fins have a first fin density in a first region occupied by some passages of said first row of passages and a second fin density in a second region occupied by other passages of said first row of passages, said first fin density being less than said second fin density, said first region being between said second region and a first side of the heat exchanger where said air inlets of said second row of passages are located.

9. The system as recited in claim 8, further comprising:

a third multiplicity of fins which partly define a third row of passages arranged side by side and aligned in said first direction, each passage of said third row having an air inlet connected to receive air from said source of relatively hotter air, an air outlet in fluid communication with said air inlet, and a constant height along its length; and a second planar plate disposed between said second and third rows of passages, wherein said first, second and third rows of passages and said first and second planar plates form a stack in which respective portions of each passage of said third row are disposed below respective portions of respective passages of said second row in a cross-flow relationship that allows heat to be transferred from any one passage of said third row to all of the passages of said second row; and wherein said third multiplicity of fins have said first fin density in a first region occupied by some passages of said third row of passages and said second fin density in a second region occupied by other passages of said third row of passages, said first region being between said second region and said first side of the heat exchanger.

10. The system as recited in claim 8, wherein said second multiplicity of fins have a third fin density in a first region occupied by some passages of said second row of passages and a fourth fin density in a second region occupied by other passages of said second row of passages, said third fin density being less than said fourth fin density, said first region being between said second region and a second side of the heat exchanger where said air inlets of said first row of passages are located.

11. The system as recited in claim 8, wherein said source of relatively colder air is a fan duct of a gas turbine engine.

12. The system as recited in claim 8, wherein said source of relatively hotter air is a compressor of a gas turbine engine.

13. The system as recited in claim 8, further comprising an environmental control system connected to receive air from said respective air outlets of said one of said first and second rows of passages having air inlets connected to receive air from said source of relatively hotter air.

14. A system comprising a source of relatively colder fluid, a source of relatively hotter fluid, and a cross-flow fluid-to-fluid heat exchanger connected to receive fluid from said source of relatively colder fluid and said source of relatively hotter fluid, wherein said heat exchanger comprises:

a first multiplicity of fins which partly define a first row of passages arranged side by side and aligned in a first direction, each passage of said first row having a fluid inlet connected to receive fluid from said source of relatively hotter fluid, a fluid outlet in fluid communication with said fluid inlet, and a constant height along its length;

a second multiplicity of fins which partly define a second row of passages arranged side by side and aligned in a second direction that is not parallel with said first direction, each passage of said second row having a fluid inlet connected to receive fluid from said source of relatively colder fluid, a fluid outlet in fluid communication with said fluid inlet, and a constant height along its length; and a first planar plate disposed between said first and second rows of passages, wherein said first and second rows of passages and said first planar plate form a stack in which respective portions of each passage of said first row are disposed above respective portions of respective passages of said second row in a cross-flow relationship that allows heat to be transferred from any one passage of said first row to all of the passages of said second row; and wherein a distance separating successive fins of said first multiplicity of fins decreases incrementally across said first row of passages from a first side of the heat exchanger where said fluid inlets of said second row of passages are located to a second side of the heat exchanger where said fluid outlets of said second row of passages are located.

15. The system as recited in claim 14, further comprising:

a third multiplicity of fins which partly define a third row of passages arranged side by side and aligned in said first direction, each passage of said third row having a fluid inlet connected to receive fluid from said source of relatively hotter fluid, a fluid outlet in fluid communication with said fluid inlet, and a constant height along its length; and a second planar plate disposed between said second and third rows of passages, wherein said first, second and third rows of passages and said first and second planar plates form a stack in which respective portions of each passage of said third row are disposed below respective portions of respective passages of said second row in a cross-flow relationship that allows heat to be transferred from any one passage of said third row to all of the passages of said second row; and wherein a distance separating successive fins of said third multiplicity of fins decreases incrementally across said third row of passages from said first side of the heat exchanger to said second side of the heat exchanger.

16. The system as recited in claim 14, wherein a distance separating successive fins of said second multiplicity of fins decreases incrementally across said second row of passages from a third side of the heat exchanger where said fluid inlets of said second row of passages are located to a fourth side of the heat exchanger where said fluid outlets of said second row of passages are located.

17. The system as recited in claim 14, wherein said fluid is air.

18. The system as recited in claim 14, wherein said source of relatively colder fluid is a fan duct of a gas turbine engine.

19. The system as recited in claim 14, wherein said source of relatively hotter fluid is a compressor of a gas turbine engine.

20. The system as recited in claim 14, further comprising an environmental control system connected to receive fluid from said fluid outlets of said first row of passages.

* * * * *